US005381941A

United States Patent [19]

Brune

[11] Patent Number: 5,381,941

[45] Date of Patent: Jan. 17, 1995

[54] PIVOTABLE SEAT MEMBER FOR BACKPACK FRAME

[76] Inventor: Paul W. Brune, Rte. 1 Box 185K, New Haven, Mo. 63068

[21] Appl. No.: 144,130

[22] Filed: Oct. 27, 1993

[51] Int. Cl.[6] ..... A45F 4/02

[52] U.S. Cl. ..... 224/155; 224/153

[58] Field of Search ..... 224/151, 153, 155, 210, 224/213, 159–162, 265; 297/4, 17, 19, 452.13, 452.29

[56] References Cited

U.S. PATENT DOCUMENTS

| | | | |
|---|---|---|---|
| 2,973,888 | 3/1961 | Beardsley | 224/155 |
| 4,022,292 | 5/1977 | Van Gompel | 224/155 |
| 4,179,053 | 12/1979 | Figura | 224/213 |
| 4,577,901 | 3/1986 | Phillips | 224/155 |
| 4,582,165 | 4/1986 | Latini | 224/155 |
| 4,776,503 | 10/1988 | Sink | 224/153 |
| 4,889,383 | 12/1989 | Jones | 297/17 |
| 5,016,792 | 5/1991 | Jay | 224/155 |
| 5,031,811 | 7/1991 | Charest | 224/155 |
| 5,131,575 | 7/1992 | Charest | 224/155 |
| 5,222,641 | 6/1993 | Medeiros, Jr. | 224/265 |

*Primary Examiner*—Henry J. Recla
*Assistant Examiner*—Gregory M. Vidovich
*Attorney, Agent, or Firm*—Robbins & Robbins

[57] ABSTRACT

A pivotable seat member for a backpack frame is provided. A seat member is pivotally attached to the backpack frame to provide seating support for the user during times of rest and, when used with a sling, to provide support to a carried load during use. The seat member is supported from the frame by adjustable straps to form a backed chair structure. The seat member is pivotable between positions on either side of the frame so that the backpack frame can be used as a free standing chair or by securing against a tree to provide an elevated seated position.

12 Claims, 3 Drawing Sheets

PIVOTABLE SEAT MEMBER FOR BACKPACK FRAME

BACKGROUND OF THE INVENTION

For people who are inclined to pursue activities in the wilderness, such as hunting, hiking and camping, efficiency in the provision and transportation of equipment is crucial. Many important necessities of life must be sacrificed in the interest of saving space and lightening the carried load because these activities take the individual off the roads and highways. Without vehicles to transport equipment, the individual must carry on his back those provisions necessary for survival, such as bedding, clothing, food, survival kits, and the like. Understandably, items of comfort, such as chairs, are usually sacrificed and left behind.

It would be desirable to these outdoorspeople to be able to sit in comfort out in the woods, yet not bear the burden of carrying around a cumbersome chair. While there exist compact foldable chairs and stools, they nonetheless still are extraneous items which must be carried on the person in transport.

SUMMARY OF THE INVENTION

By means of the instant invention there is provided an improvement for a backpack support frame which enables the frame to be used as a free-standing chair support, or, alternatively, to be secured to a tree to provide an elevated seat support. The invention also increases the load-carrying ability of the frame with respect to loose items, such as firewood or game.

The invention comprises a U-shaped frame member for pivotable connection with the bottom of a standard backpack frame. A canvas seat member is stretched over the frame member to provide seating support. Suspension straps are provided for attachment to the backpack frame and are used to support the U-shaped frame member in a seat position.

When the U-shaped frame member is positioned in a rearward orientation, the backpack frame can be secured to a vertical support such as a tree to provide an elevated seating arrangement. Straps are provided for cinching the backpack frame to the tree. The backpack frame/seat can also be used standing alone on the ground with the seat member in both the forward and rear positions. For greater comfort, the seat member can be swung to the forward position so that the user can rest his back in the concave hollow of the backpack frame.

A load support sling is provided for carrying items such as firewood or game. It is comprised of a broad fabric which connects between the backpack frame and outer edge of the seat member and provides a shelf on which the load is placed for support. Binding straps are employed for securing the load on the sling.

It is therefore an object of this invention to provide a compact seat attachment for use with a backpack frame to enable the user to transform his or her backpack into a chair.

It is further an object of this invention to provide extra load carrying ability to the backpack frame.

The above features are objects of this invention. Further objects will appear in the detailed description which follows and will be otherwise apparent to those skilled in the art.

For purpose of illustration of this invention a preferred embodiment is shown and described hereinbelow in the accompanying drawing. It is to be understood that this is for the purpose of example only and that the invention is not limited thereto.

IN THE DRAWINGS

DESCRIPTION OF THE INVENTION

Figure 1:
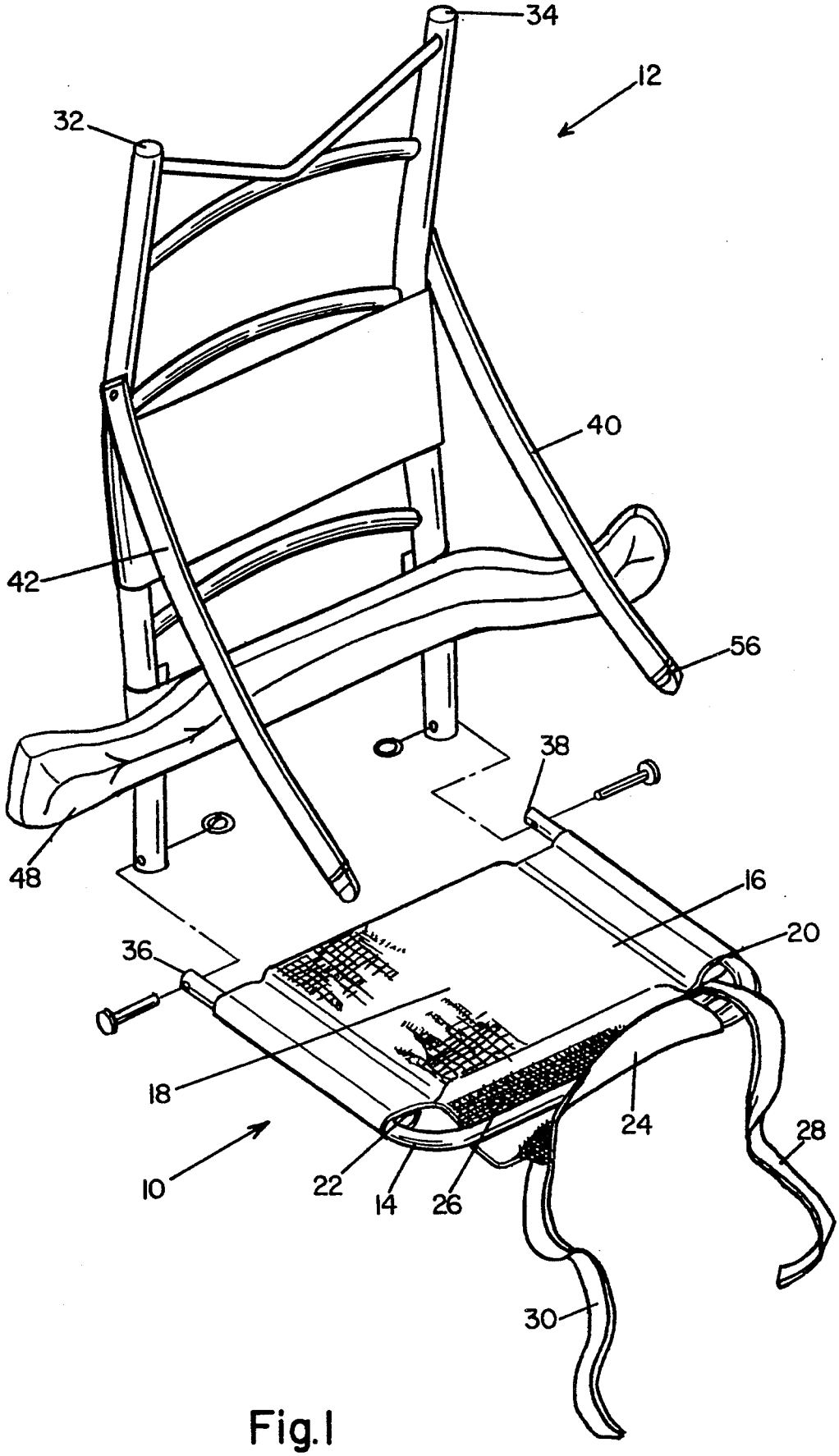
FIG. 1 is a perspective view of the seat member and backpack frame, showing in exploded view their point of attachment.

The seat member of the instant invention, generally indicated by the reference numeral 10, is provided as an attachment to standard backpack frames, generally indicated by the reference numeral 12. The seat member, as shown in FIG. 1, is best comprised of a U-shaped frame member 14 cast of an aluminum alloy or other suitable light weight material. A durable fabric 16, such as canvas or the like, is stretched over U-shaped frame member 14 to provide a seating surface 18. Fabric 16 is sewn or stitched to form openings 20 and 22 for sliding over the legs of U-shaped frame member 14, and has a flap 24 lined with Velcro ® material 26 for quick connect/disconnect around the base of U-shaped frame member 14. Straps 28 and 30 are formed from or stitched on to fabric 16. FIG. 1 shows these straps stitched to flap 24.

Figure 2:
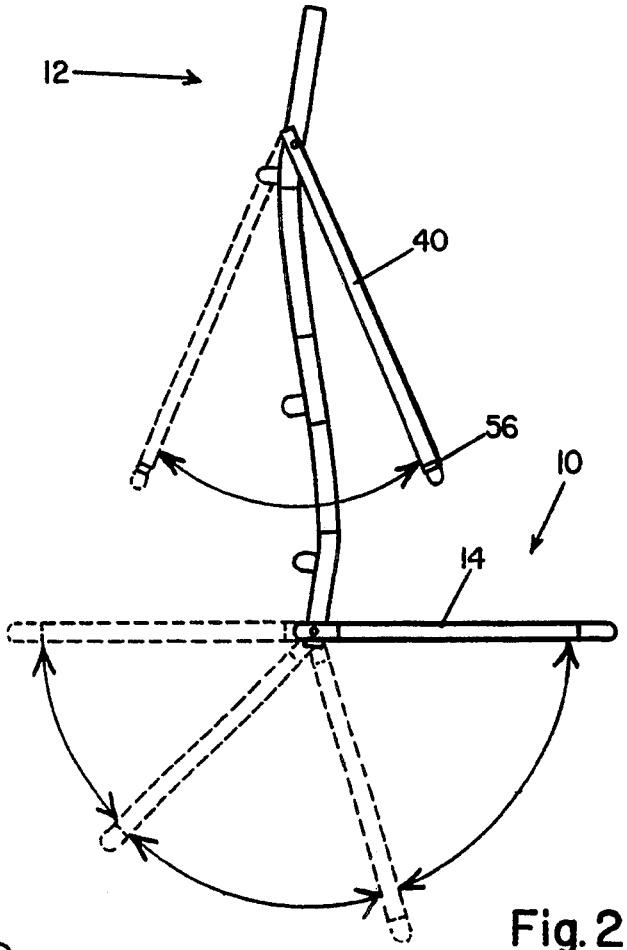
FIG. 2 is a view in side elevation from the side of the backpack frame showing the range over which the seat member pivots.

Seat member 10 is constructed for attachment to a standard backpack frame 12 of the type having an aluminum framework consisting of a pair of parallel rails 32 and 34 with a plurality of cross braces. This type of backpack frame is well known in the art and does not itself form part of the instant invention per se. Ends 36 and 38 of U-shaped frame member 14 align for connection to the bottoms of rails 32 and 34 as shown in FIG. 1. Connection is made by alignment of holes between rails 32 and 4 and ends 36 and 38 of seat member 10, and the use of cotter pins or the like. This allows the seat member 10 to be pivoted back and forth along an axis between the points of connection. FIG. 2 shows seat member 10 being swung between positions on either side of backpack frame 12.

Figure 3:
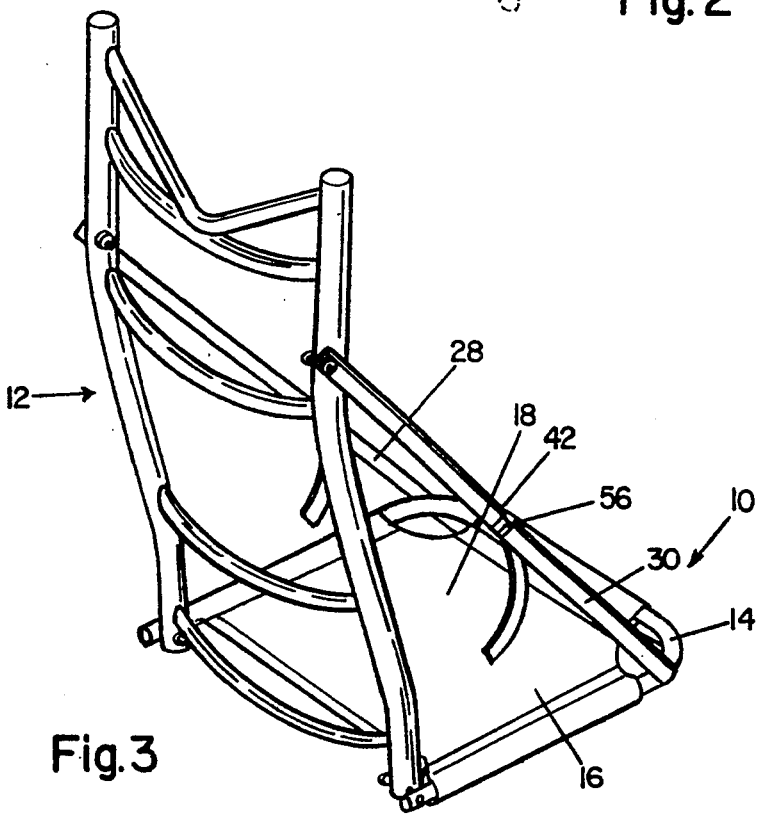
FIG. 3 is a perspective view of the erected backpack seat.

Suspension straps 40 and 42 are provided for supporting seat member 10 in suspension from the backpack frame as shown in FIG. 3. Straps 40 and 42 can be connected to rails 32 and 34 by means of bolting, cotter pins, or other suitable fastening means, but should be allowed to swivel along its point of connection to accommodate seat member 10 on either side of backpack frame 12. The free ends of suspension straps 40 and 42 have buckle members for receiving straps 28 and 30 from seat fabric 16. Alternatively, straps 40 and 42 can be provided with means for direct connection with seat member 10, such as hooks or the like.

Figure 4:
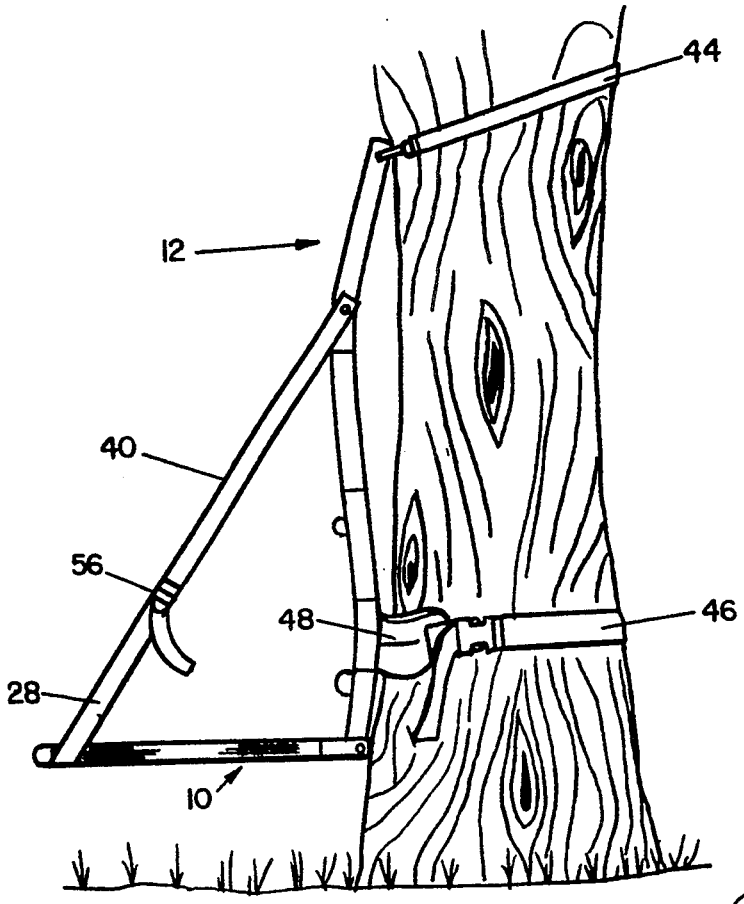
FIG. 4 is a view in side elevation from the side showing the backpack seat secured to a tree at an elevated position.

Cinch straps 44 and 46 are provided for securing backpack frame 12 to a tree as shown in FIG. 4. Strap 44 is connected by bolt, cotter pin or the like, to rails 32 or 34, and has buckle means for cinching tight around the tree. Strap 46 is adapted to engage waist belt 48, which is a common feature of most backpack frames, and also has buckle means for cinching around the tree.

Figure 5:
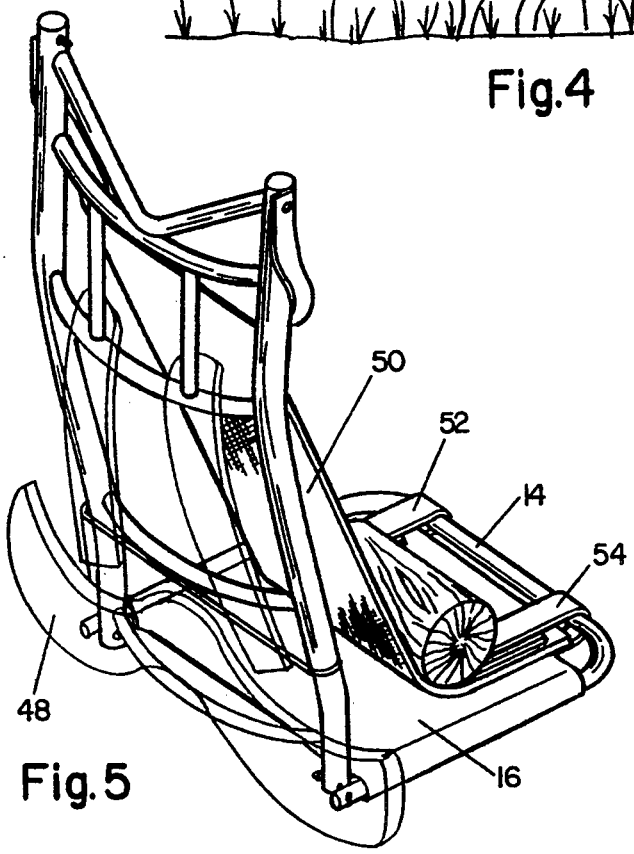
FIG. 5 is a perspective view of the backpack frame and seat member showing the use of a sling member for additional load support.
Figure 6:
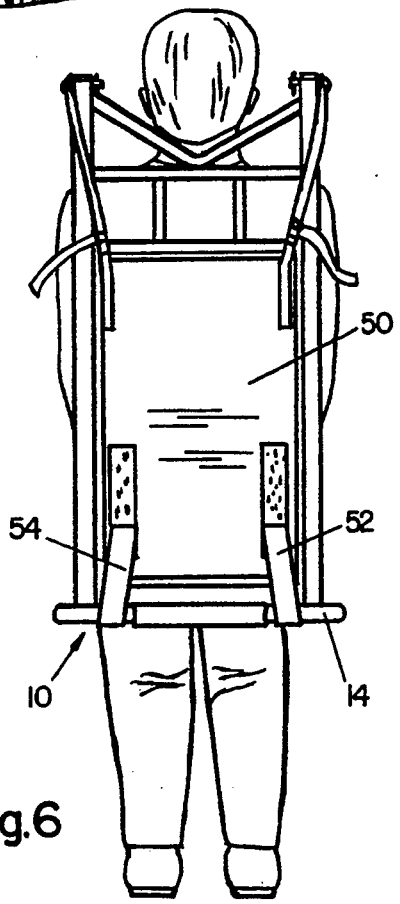
FIG. 6 is a view in side elevation from the rear showing the backpack frame, seat member, and sling member in use.

An auxiliary sling member 50 is provided for supplementary load support and is comprised of a wide fabric having straps for connection between the backpack frame 12 and seat member 10 as shown in FIGS. 5 and 6. Lower straps 52 and 54 have Velcro ® attachment means for quick connect/disconnect on U-shaped frame member 14.

USE

The pivotable seat member 10 of the instant invention is very simply employed for converting a standard backpack frame 12 into a free standing sling-type chair as seen in FIG. 3, or an elevated chair for use on a tree or other vertical support as seen in FIG. 4. Seat member 10 is supported to backpack frame 12 by joining suspension straps 40 and 42 to seat fabric straps 28 and 30, respectively. Adjustable buckles 56 allow the relative angle between seat member 10 and backpack frame 12 to be varied at the user's choice for comfort. In this erected arrangement, the chair can stand alone on the ground, or be raised off the ground.

Most backpack frames are conformed with a slight curvature in the vertical plane. Therefore, the optimum position of seat member 10 on either side of backpack frame 12 will depend on the particular use. When used as a free standing seat, as in FIG. 3, seat member 10 will be swung into position on the front side of backpack frame 12, so that the user's back will fit comfortably into the bowed area. When used as an elevated seat against a vertical support, as in FIG. 4, seat member 10 will be positioned on the back side of the backpack frame 12, so that the tree will be nestled in the bowed area. This arrangement is preferable in securing the frame against the tree.

Sling member 50 is used for carrying an additional load, such as firewood, as seen in FIG. 5, or bagged game. By connection with pivotable seat member 10, it provides a shelf for load support. The sling is adjustable in length so that the depth of the effective shelf can be varied depending on the load.

The pivotable seat member of the instant invention can be provided as an additional original feature of a backpack frame, or can be sold as a kit for adding on to an existing backpack frame.

Various changes and modifications may be made within this invention as will be apparent to those skilled in the art. Such changes and modifications are within the scope and teaching of this invention as defined in the claims appended hereto.

What is claimed is:

1. A seat member comprising a U-shaped framework and a fabric member, said fabric member having means for being connected to said framework to form a seat capable of removable attachment to a backpack frame having a front and rear side, said seat member having means for being pivotally connected to said backpack frame at a bottom end thereof such that said seat member is pivotable over a range between a first position substantially parallel to the front side of said backpack frame and a second position substantially parallel to the rear side of said backpack frame, said seat member having means for being supported from a vertical support member of said backpack frame, said seat member being of a sufficient dimension to support a person, whereby an effective seat is formed with said backpack frame, suspension straps adapted to be connected to said backpack frame having supporting means for supporting said seat member from said backpack frame, said suspension straps being adjustable whereby the angular orientation of said seat member to said backpack frame is adjustable to provide variation in the pitch of said effective seat.

2. The seat member of claim 1 in which said effective seat is capable of free-standing use on the ground.

3. The seat member of claim 1 in which means are provided for connecting said effective seat to a vertical support, whereby an elevated seat is provided.

4. The seat member of claim 1 in which said seat member is pivotable over an angular range in relation to said backpack frame, and a load support sling member is provided for attachment between said backpack frame and an outer edge of said seat member, whereby a carried load is supported by said sling member between said seat member and said backpack frame.

5. The seat member of claim 1 in which said fabric member is removable from said U-shaped framework.

6. The seat member of claim 1 in which fabric straps extend from and are integral with an outer edge of said fabric member, said fabric straps having means for connection with said vertical support member of said backpack frame whereby said seat member is supported.

7. In a backpack frame, the improvement comprising a seat member comprising a U-shaped framework and a fabric member, said fabric member having means for being connected to said framework to form a seat capable of removable attachment to said backpack frame having a front and rear side, said seat member having means for being pivotally connected to said backpack frame at a bottom end thereof such that said seat member is pivotable over a range between a first position substantially parallel to the front side of said backpack frame and a second position substantially parallel to the rear side of said backpack frame, said seat member having means for being supported from a vertical support member of said backpack frame, said seat member being of a sufficient dimension to support a person, whereby an effective seat is formed with said backpack frame, suspension straps adapted to be connected to said backpack frame having supporting means for supporting said seat member from said backpack frame, said suspension straps being adjustable whereby the angular orientation of said seat member to said backpack frame is adjustable to provide variation in the pitch of said effective seat.

8. The backpack frame of claim 7 in which said effective seat is capable of free-standing use on the ground.

9. The backpack frame of claim 7 in which means are provided for connecting said effective seat to a vertical support, whereby an elevated seat is provided.

10. The backpack frame of claim 7 in which said seat member is pivotable over an angular range in relation to said backpack frame, and a load support sling member is provided for attachment between said backpack frame and an outer edge of said seat member, whereby a carried load is supported by said sling member between said seat member and said backpack frame.

11. The backpack frame of claim 7 in which said fabric member is removable from said U-shaped framework.

12. The seat member of claim 7 in which fabric straps extend from and are integral with an outer edge of said fabric member , said fabric straps having means for connection with said vertical support member of said backpack frame whereby said seat member is supported.

* * * * *